US005893313A

United States Patent [19]

Mori

[11] Patent Number: 5,893,313

[45] Date of Patent: Apr. 13, 1999

[54] CORNER CUTTER

[75] Inventor: Chuzo Mori, Tokyo, Japan

[73] Assignee: Carl Manufacturing Co., Ltd., Tokyo, Japan

[21] Appl. No.: 08/955,798

[22] Filed: Oct. 22, 1997

Related U.S. Application Data

[63] Continuation-in-part of application No. 08/636,302, Apr. 23, 1996, abandoned.

[30] Foreign Application Priority Data

Sep. 5, 1995 [JP] Japan ..... 7-251795

[51] Int. Cl.[6] ..... B26D 1/00

[52] U.S. Cl. ..... 83/694; 83/583; 83/684

[58] Field of Search ..... 83/583, 636, 694, 83/679, 684, 685, 686, 688, 689, 467.1; 30/358, 360, 361

[56] References Cited

U.S. PATENT DOCUMENTS

| | | | |
|---|---|---|---|
| 376,136 | 1/1888 | Burrowes | 30/358 X |
| 2,082,867 | 6/1937 | Andersen | 83/694 |
| 2,259,351 | 10/1941 | Oberholser et al. | 83/583 |
| 2,936,665 | 5/1960 | Naffin | 83/694 |
| 3,465,634 | 9/1969 | Blais | 83/686 X |
| 3,516,317 | 6/1970 | Sundquist et al. | 83/466.1 X |
| 3,656,387 | 4/1972 | Wark | 83/374 X |
| 4,481,848 | 11/1984 | Ikeda | 83/693 |
| 4,932,129 | 6/1990 | Schellstede et al. | 30/358 X |
| 4,989,482 | 2/1991 | Mason | 83/686 X |
| 5,146,832 | 9/1992 | Wilson et al. | 83/684 X |
| 5,495,671 | 3/1996 | Shun-Yi | 30/358 X |

FOREIGN PATENT DOCUMENTS

| | | | |
|---|---|---|---|
| 0268162 | 5/1988 | European Pat. Off. | 83/684 |
| 405447 | 2/1934 | United Kingdom | 30/358 |
| 8911931 | 12/1989 | WIPO | 83/684 |

*Primary Examiner*—M. Rachuba
*Attorney, Agent, or Firm*—Oliff & Berridge, PLC

[57] ABSTRACT

A paper cutter is provided with a stationary blade and a movable blade unit. The movable blade unit is provided with a circular blade for cutting a rounded corner of a sheet of paper and a corner cutter blade for cutting the corner edge of the sheet of paper. The movable blade unit is inserted in a movable blade inserting hole provided in the stationary blade, the corner of the paper is inserted in a slit cut in the stationary blade which intersects with the movable blade inserting hole. During the cutting of the corner by the circular blade, the corner of the paper is tensioned between the circular blade and the corner cutter blade. As a result, the paper is cleanly and uniformly cut and the force required to cut the paper is decreased as compared to conventional paper cutters.

8 Claims, 9 Drawing Sheets

CORNER CUTTER

This is a continuation in part of application Ser. No. 08/636/302 filed Apr. 23, 1996, now abandoned.

BACKGROUND OF THE INVENTION

1. Field of the Invention

The present invention relates to a corner cutter to cut a corner of sheet of paper in a rounded shape.

2. Description of Related Art

Conventionally, in general, there is a case where the corners 2 of sheets of paper such as "Loose Leaf" (a trade name) to be bound in a binder are to be cut in a rounded shape. In this case, since there has not been an appropriate corner cutter, normal scissors have been used to cut the corner in a circular shape. And, the corners of such as loose leaf found in the market are mostly rounded and usually have been cut, as shown in FIG. 10, by pushing down a cutter 3 of a semi-circular shape and cutting the corner 4 of the stacked sheets of paper 1.

In the above conventional manner, when cutting the corners of sheets of paper using scissors, the rounded arches of the cut corners do not align for a good appearance. The process is also inefficient for making multiple corners rounded at one time. And, when using the semi-circular cutter 3 as shown in FIG. 10, the likelihood of injury to the user is high and, in addition, it becomes expensive when the cutter 3 is pushed down mechanically.

SUMMARY OF THE INVENTION

The present invention relates to a corner cutter which gives corners of the paper the stable rounded shape, is very simple in operation as a business machine and is inexpensive.

In a preferred embodiment, the present invention comprises, in order to solve the above problem, a stationary blade and two movable blades. The stationary blade is provided with a slit for papers to be inserted for being cut and a hole perpendicular to the slit, into which the movable blades are inserted. The stationary edge is formed at the position where the slit and the hole into which the movable blades are inserted intersect. The movable blades consist of a circular blade for cutting away a corner of the paper in a rounded corner shape and a corner cutter blade for cutting the corner in a linear line. The radius of the circular blade is made larger than the radius of any circle tangential to the sides of the corner of the paper.

According to another embodiment of the present invention, the circular blade and the corner cutter blade are formed concave to the stationary edge respectively (as shown in FIGS. 1 and 6).

According to another embodiment of the present invention, support portions are formed on both sides of the circular edge blade and the corner cutter blade.

The present invention is attained as follows. As shown in FIG. 1, the cutter comprises a stationary blade 5 and two movable blades 10, 11. The stationary blade 5 is provided with a slit 6 into which papers to be cut in rounded corner shape are inserted. Perpendicular to the slit 6, a movable blade inserting hole 8 is provided. A stationary edge 9 is formed at the intersection of the slit 6 and the movable blade inserting hole 8. Circular blade 10 and corner cutter blade 11 (the two movable blades) are fixed to each other and move together as a movable blade unit 7. As shown in FIG. 2, on the bottom end of the movable blade unit 7 to be inserted in the hole 8, the circular blade 10 for cutting the rounded corner 102 of the paper 1 and the corner cutter blade 11 for cutting the corner edge 101 of the paper 1 are provided. The radius R of the circular blade 10 is made larger than the radius R1 (refer to FIG. 11) of any circle which is tangential to the sides of a square corner of a paper.

In one embodiment of the present invention, the circular blade 10 and the corner cutter blade 11, which are provided on the bottom of the movable blade unit 7, are configured concave to the stationary edge 9.

In another embodiment of the present invention, guide portions 12 are provided on both sides of the concave edge of the above circular blade 10 and the corner cutter blade 11 respectively.

DETAILED DESCRIPTION OF PREFERRED EMBODIMENTS

Figure 1:
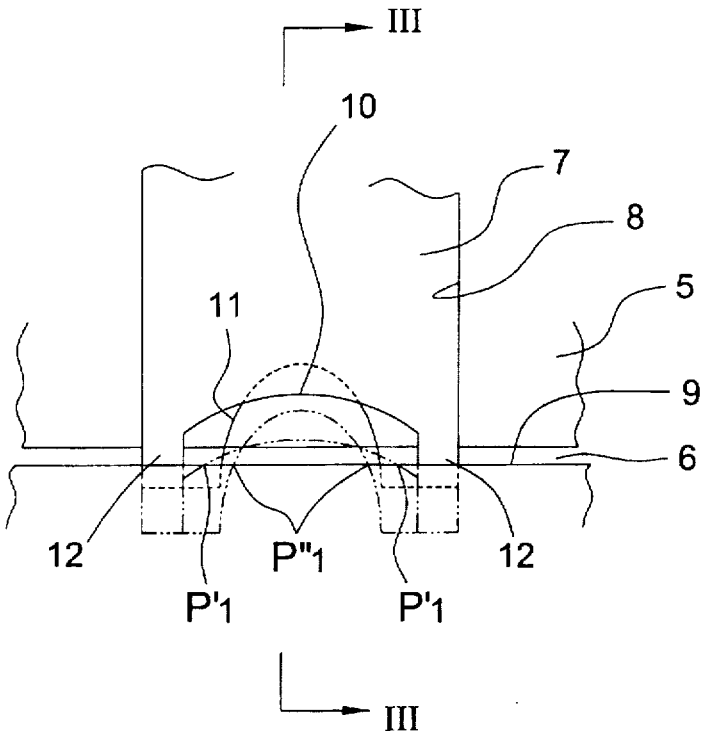
FIG. 1 is a front view of the main part of the movable blade in the embodiment of the present invention.

Hereinafter, an embodiment of the present invention will be explained. First, based on FIG. 5, a corner cutter is explained as a whole. The movable blade unit 7 is fastened to a spring receiver 16 for accepting a spring 17 and a holding portion 15 for pushing the movable blade unit 7 down. Above the upper surface of the stationary blade 5 a spring holding portion 22 for holding the spring 17 is projected and the movable blade inserting hole 8 passes through the slit 6 in such a manner as it intersects perpendicular to the slit 6. A cap 13 is positioned while inserting the spring 17 between the stationary blade 5 and the spring receiver 16, inserting the holding portion 15 in the hole 14 pierced in the cap 13 and coupling the cap 13 with the stationary blade 5. The spring 17 is fixed between the stationary blade 5 and the spring receiver 16. When pushing the holding portion 15 projected from the hole 14 provided on the cap 13, the movable blade unit 7 is pushed down against the force of the spring 17.

On the bottom plate 18, the guide portions 19 for guiding the sides 104 of the paper 1 are provided, and by inserting the sides 104 of the paper 1 into the slit 6 and guiding them along the guide portions 19, the corner edge 101 is positioned at an appropriate position with respect to the stationary edge 9 (FIG. 1) of the stationary blade 5. The cutting waste is disposed from hole 20. Cover 21 protects hands from touching the edges of the blades when pushing down the movable blade unit 7. This bottom plate 18 is mounted removably on the back surface of the stationary blade 5.

Figure 5:
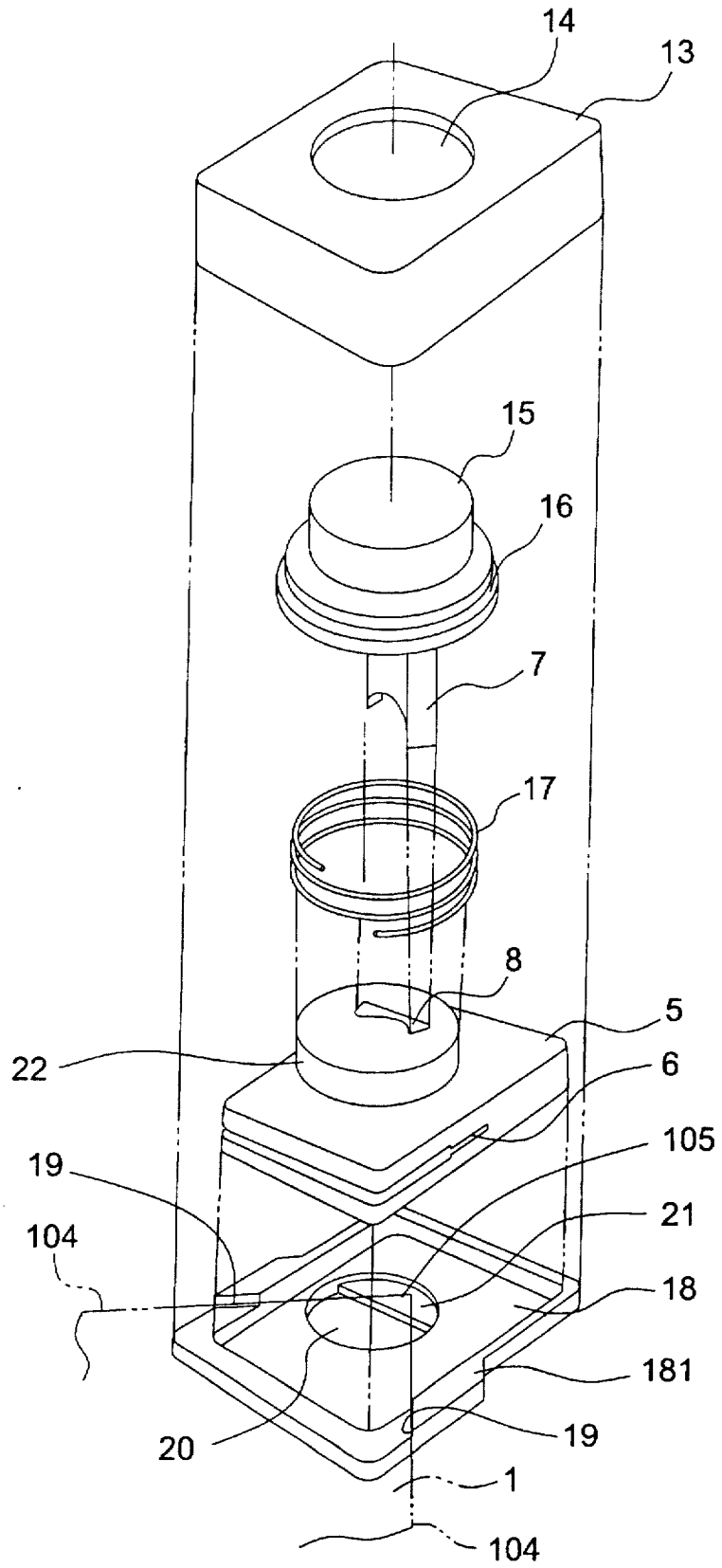
FIG. 5 is a perspective view of a broken corner cutter.
Figure 6:
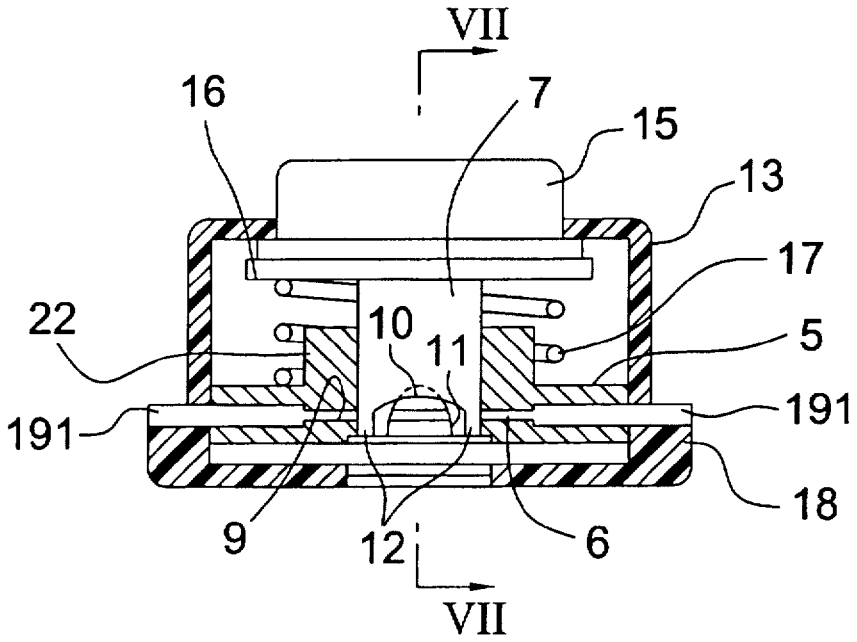
FIG. 6 is a vertically sectional view of the corner cutter assembled.
Figure 7:
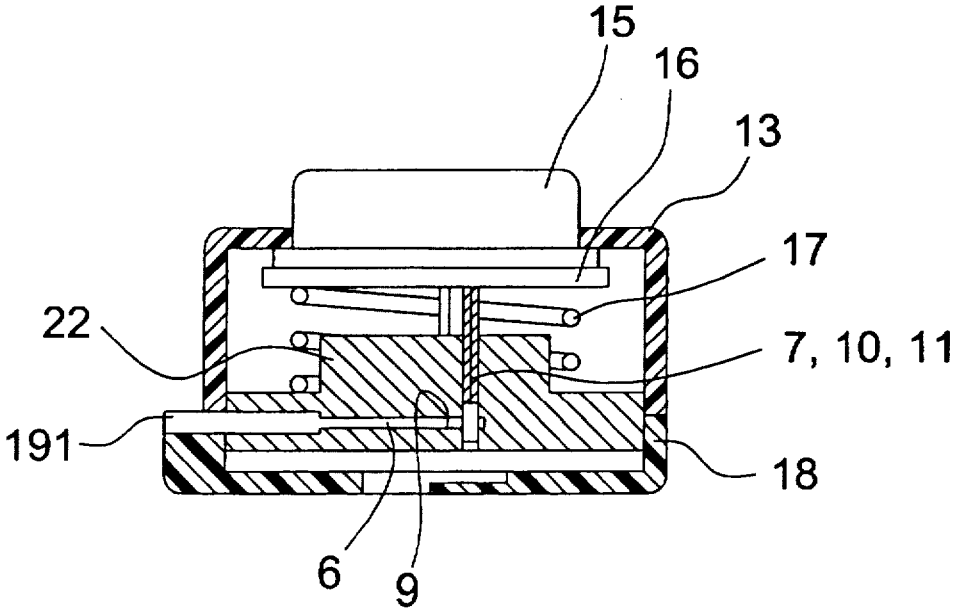
FIG. 7 is a sectional view in vertical along section line VII—VII of FIG. 6.

FIGS. 6 and 7 show the assembled corner cutter in vertical section. As shown in FIGS. 6 and 7, when the cap 13 is in place on the upper surface 181 (FIG. 5) of the bottom plate 18 so that the bottom end of the cap 13 is in contact with upper surface 181, a gap 191 is formed due to the step of the guide portions 19. This gap 191 is in line with the slit 6 provided in the stationary blade 5 so that the paper 1 can be inserted by being guided by the guide portions 19 into the slit 6.

Figure 2:
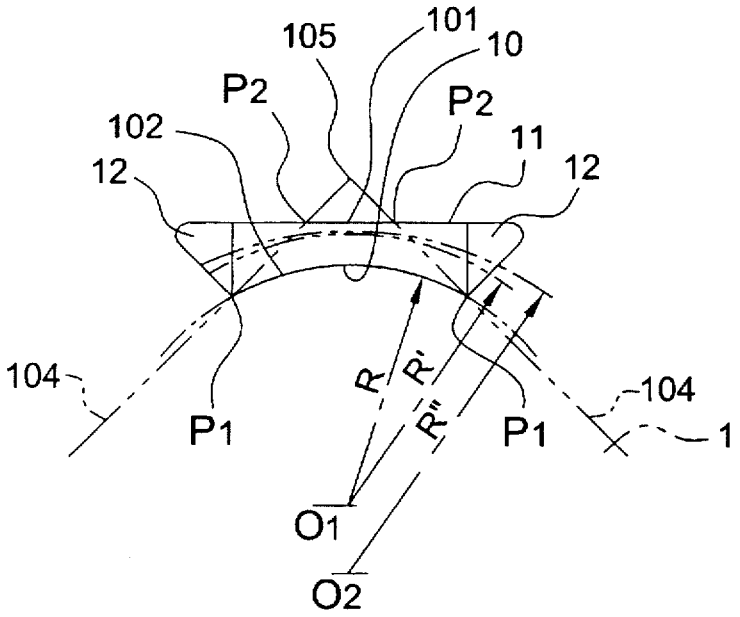
FIG. 2 is a bottom view of FIG. 1.
Figure 11:
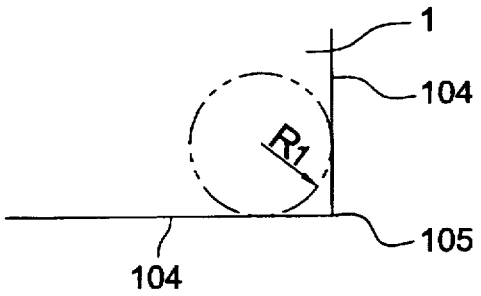
FIG. 11 is for general explanation for a corner cutting.
Figure 12:
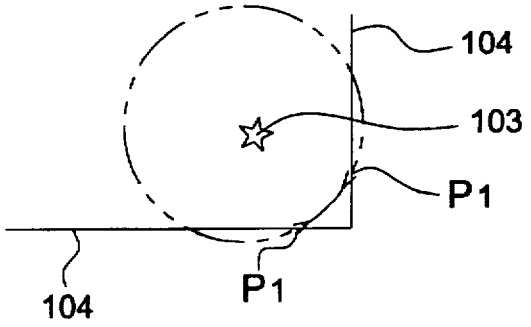
FIG. 12 is for general explanation for a corner cutting.

FIGS. 1 and 2 show the details of the main portion of the movable blade unit 7 of FIG. 5. FIG. 2 shows the bottom of the movable blade unit 7. At the bottom end of the movable blade unit 7, the circular blade 10 for cutting the rounded corner 102 of the paper 1 in a rounded shape and the corner cutter blade 11 for cutting the corner edge 101 of the paper 1 are provided. The width T between the center of the circular blade 10 and the corner cutter blade 11 is set such that the corner 105 of the paper 1 projects from the corner cutter blade 11 when it is set along the guide portions 19. Further, She radius of curvature of the radius R of the circular blade 10 is, as shown in FIG. 11, set larger than the radius R1 of the circle which is tangential to the sides 104 of the paper 1. On the other hand, the corner cutter blade 11 is formed linear in this embodiment. That is, by setting R>R1, the circular blade 10 and the sides 104 intersect at points P1, P1. As seen in FIG. 1, the front view of the movable blade unit 7, by making the configuration of the circular blade 10 and the corner cutter blade 11 concave to the stationary edge 9, the paper 1, as shown by the arrows in FIG. 12, is cut from the intersections P1, P1 toward the inside. This cutting is carried out like scissors which cut paper. Thus, by cutting the paper 1 from P1, P1 toward the inside, the stuffing up of the paper 1 between the movable blade unit 7 and the stationary blade 5 may be prevented and the cutting of the paper is performed with less effort.

Figure 14:
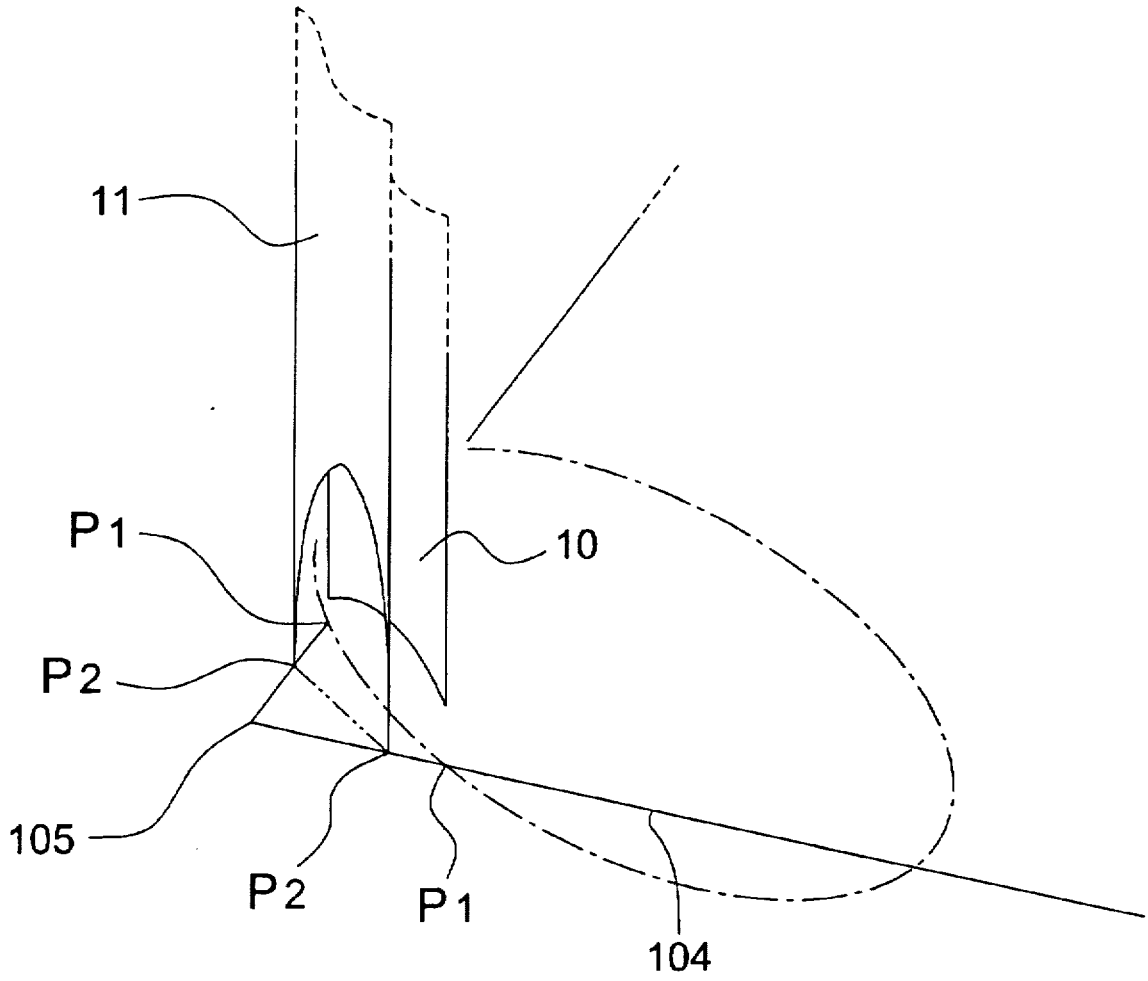
FIG. 14 is a view of the circular blade and the corner cutter blade in the embodiment of the invention wherein the circular blade begins to cut the paper after the corner cutter blade.
Figure 15:
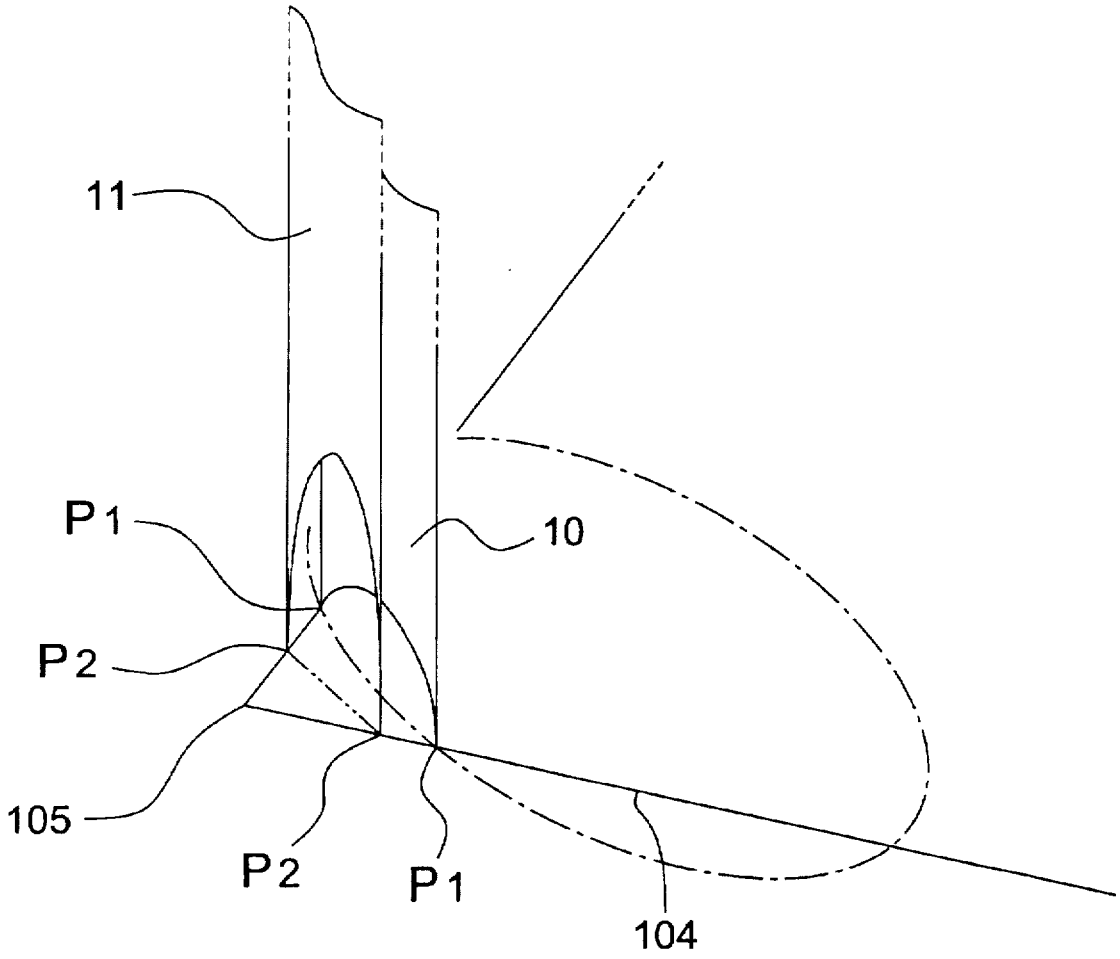
FIG. 15 is a view of the circular blade and the corner cutter blade in the embodiment of the invention wherein the corner cutter blade begins to cut the paper at the same time as the circular blade.

Furthermore, as shown in FIG. 2 the configuration of the corner cutter blade 11 may be designed so that the depth of the concavity of the corner cutter blade 11 and its vertical position relative the circular blade 10 are set so that immediately before the circular blade 10 reaches the points P1, P1 of the sides 104 of the paper 1, the corner cutter blade 11 starts to cut the points P2, P2 of the corner edge 101 of the paper 1. Until the circular blade 10 finishes cutting along the line P1—P1, the corner cutter blade 11 still remains in cutting process along the line P2—P2. By the cutting blades being operated as described above, while cutting the rounded corner 102 of the paper 1 with the circular blade 10, the corner cutter blade 11 holds the corner edge 101 to prevent the corner edge 101 from slipping away. Therefore, the circular blade 10 can cut the rounded corner 102 of the paper 1 properly. FIG. 14 shows an example of this configuration of the circular blade 10 and the corner cutter blade 11.

Further, in the present embodiment, the circular blade 10 is formed semi-circular of radius R and the corner cutter blade 11 is linear. Due to the support portions 12 of movable blade unit 7, the dimension T of FIG. 2 can be set as small as possible. Thereby, points P2, P2 can approach points P1, P1 at the time of cutting, the starting of holding (simultaneous cutting) the corner edge 101 begins as soon as possible and, while preventing the corner edge 101 from slipping away, the circular blade 10 can cut the rounded corner 102 in the radius R more securely.

In addition, although the configuration of the corner cutter blade 11 is linear, by making the dimension T as small as possible as allowed by the circular blade 10 and the corner cutter blade 11, the cutting in the radius R by the circular blade 10 may be more secured. This is because making the corner cutter blade 11 approach an arch having the concentric radius R' from the same center $O_1$ of the circular blade 10, as shown in FIG. 2, points P2, P2 approach points P1, P1 at an early time to hold the corner edge 101. Further, the corner cutter blade 11 may be formed in a larger radius of R", the center of which is shifted from the center $O_1$ of the circular arch of the circular blade 10 to $O_2$. In that case, the configuration of the movable blade inserting hole 8 shown in FIG. 4 is made to the circular arch having the radius R" of the center $O_2$ from the radius R' of the center O.

Thus, the corner 105 of the paper 1 is cut by both the circular blade 10 and the corner cutter blade 11 so that the escape of the corner edge 101 from being cut is prevented and the rounded corner 102 is cut in a tensioned state. As a result, as compared to the case in which the paper is cut only between, for instance, the circular blade 10 and the stationary edge 9, the clearance precision between the stationary edge 9 and the circular blade 10 and the corner cutter blade 11 can be loosened by ½ of the conventional clearance. Accordingly, the workability of the circular blade 10, the corner cutter blade 11 and the stationary edge 9 becomes improved.

Figure 9:
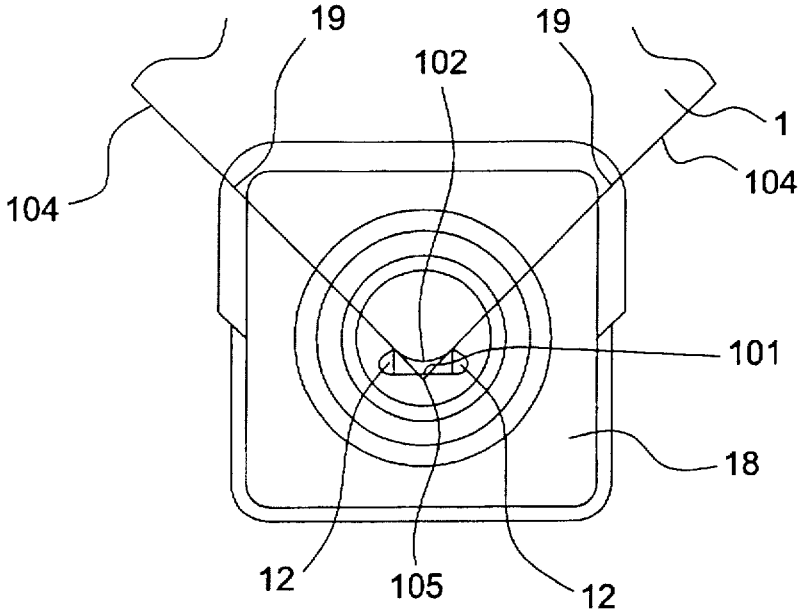
FIG. 9 is a bottom view of the bottom plate of FIG. 5.
Figure 10:
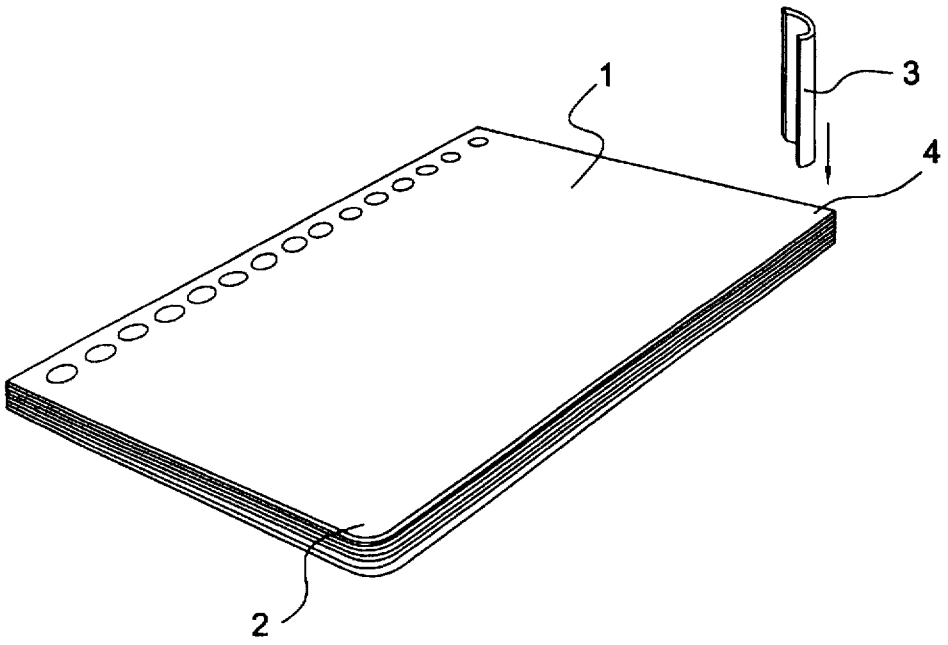
FIG. 10 (PRIOR ART)
FIG. 10 is a perspective view of a conventional art.

On both sides of the concave edge of the circular blade 10 and the corner cutter blade 11, there are provided support portions 12. The length of the support portions 12 is such that the support portions 12 cross the stationary edge 9 even when the movable blade unit 7 is lifted to its upper most position due to the elastic force of the spring 17. Thereby, the circular blade 10 and the corner cutter blade 11 can cross the slit 6 smoothly and the clearance precision between the stationary edge 9 is increased. As shown in FIG. 9, while the sides 104 of the paper 1 inserted in the slit 6 are guided by the guide portions 19 provided on the bottom plate 18, the positioning precision of the paper 1 to the circular blade 10 is increased. Thereby, an uneven cut of the rounded corner 102 of the paper 1 is avoided.

Figure 4:
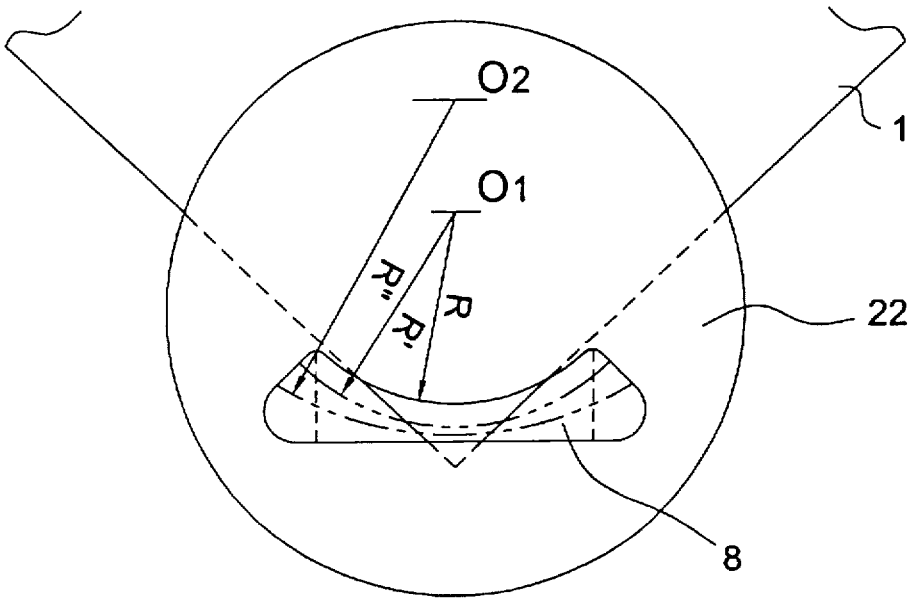
FIG. 4 is a plan view of the holding portion provided on the stationary blade.
Figure 8:
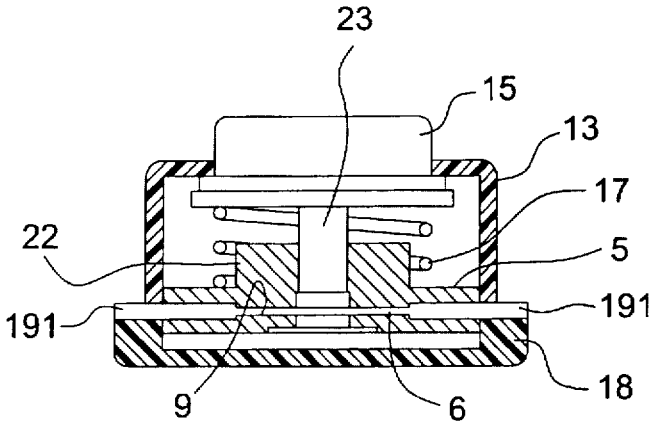
FIG. 8 shows the portion of punching out blade in vertical section, which is provided together with the corner cutter.

FIG. 4 shows the plan view of the spring holding portion 22 of the stationary blade 5 and that the configuration of the movable blade inserting hole 8 is similar to that of the movable blade unit 7. FIG. 8 shows the case where a punch 23 is provided together with the movable blade unit 7, in which, for instance as shown in FIG. 12, the cutting of the rounded corner 102 is carried out simultaneously with the punching of a pattern 103. In the case where this punch 23 is provided, a hole which is similar to the pattern and crosses through the slit 6 perpendicularly is provided in the stationary blade 5 separately from the movable blade inserting hole 8.

Figure 3:
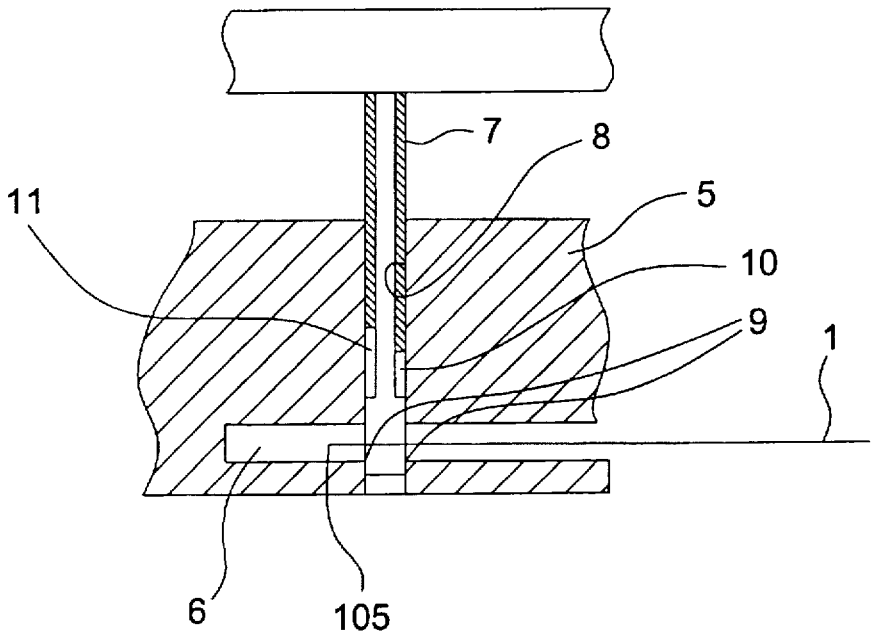
FIG. 3 is a sectional view of the main portion along section line III—III of FIG. 1.

The function of the described embodiments of the present invention will be explained next. As shown in FIG. 3, the corner 105 of the paper 1 inserted in the slit 6 is located so as to be cut between the stationary blade 5 and the circular blade 10 for cutting the rounded corner 102 of the paper 1 and the corner cutter blade 11 for cutting the corner edge 101 of the paper 1, which are provided on the bottom end of the movable blade unit 7 crossing through the movable blade inserting hole 8. Therefore, during the cutting of the corner edge 101 by the corner cutter blade 11, both the circular blade 10 and the corner cutter blade 11 can cut the corner 105. Thus, simultaneously, both the circular blade 10 and the corner cutter blade 11 can cut the corner 105. As a result, the rounded corner 102 is tensioned between the circular blade 10 and the corner cutter blade 11 and the corner edge 101 is held by the corner cutter blade 11 when the rounded corner 102 is cut in the given radius by the circular blade 10.

Since the radius R of the circular blade 10 is made larger than the radius R1 (refer to FIG. 11) tangential to the sides 104 of the paper 1, the rounded corner 102 does not bite between the circular blade 10 and the stationary edge 9 and the circular blade 10 cleanly cuts the rounded corner 102 at P1, P1.

Further, the movable blade inserting hole 8 is provided by crossing laterally perpendicular to the slit 6 provided on the stationary blade 5 so that at the intersection where the slit 6 and the movable blade inserting hole 8 cross, the stationary edge 9 is formed and the rounded corners 102 of the paper 1 stacked and inserted in the slit 6 are cut in the same radius.

The configuration of the circular blade 10 and the corner cutter blade 11 of the movable blade unit 7 is concave to the stationary edge 9. Therefore, when the movable blade unit 7 is pushed down, as shown in a phantom line in FIG. 1, the corner of the paper 1 is cut at the intersections of P1' and P1" which are formed between the stationary edge 9 and the circular blade 10 and the corner cutter blade 11, respectively. This causes the invention to operate lightly like scissors, and, as shown in FIG. 12, the rounded corner 102 is cut from both sides similarly in the arrow direction, so that the position of paper 1 is not displaced at the time of cutting.

Since, on both sides of the concave edge of the circular blade 10 and the corner cutter blade 11, the support portions 12 are provided, as shown in FIG. 2, the rounded corner 102 can be positioned to the circular blade 10. Further, as shown in FIG. 6, when the movable blade unit 7 is lifted up due to the resilient force of the spring 17, the support portions 12 are long enough that they remain in the stationary edge 9, thereby the clearance between the stationary edge 9 and the circular blade 10 and the corner cutter blade 11 can be maintained precisely in order to provide a precise cut.

As mentioned above, according to an embodiment of the present invention, the movable blade unit 7, having the circular blade 10 for cutting the rounded corner 102 of the paper and the corner cutter blade 11 for cutting the corner edge 101 of the paper at the bottom end, is inserted in the movable blade inserting hole 8 and adapted to cut the rounded corner 102 of the paper 1 inserted in the slit 6 between the stationary edge 9 and the circular blade 10 and the corner cutter blade 11. During the cutting of the rounded corner 102 by the circular blade 10, both the circular blade 10 and the corner cutter blade 11 cut the corner 105. The corner 105 is tensioned between the circular blade 10 and the corner cutter blade 11 as if the corner cutter blade 11 holds the corner edge 101 and the rounded corner 102 is cut in a given radius. Thereby, there is no bite of the paper, the easy handling is secured and uneven alignment of the cut corners disappears.

Further, since the movable blade inserting hole 8 crosses laterally in a right angle direction, the stationary blade 5 is formed at the intersection where the slit 6 and the movable edge inserting hole 8 intersect and the stacked corners inserted in the slit 6 are cut vertically at the same radius, the productivity is effective and there is no anxiety of displacement even if stacked papers are cut, avoiding the uneven alignment of the cut corners.

Further, since the radius R of the circular blades 10 is larger than the radius R1 of the circle tangential to the sides 104 of the paper 1 and there exists no biting of the rounded corner 102 between the stationary edge 9 and the circular blade 10, there are no stuffed corners, the operation as a business machine becomes easy and the cutting position relative to the corner 105 is uniform so as to diminish the uneven alignment of the cut corners.

Figure 13:
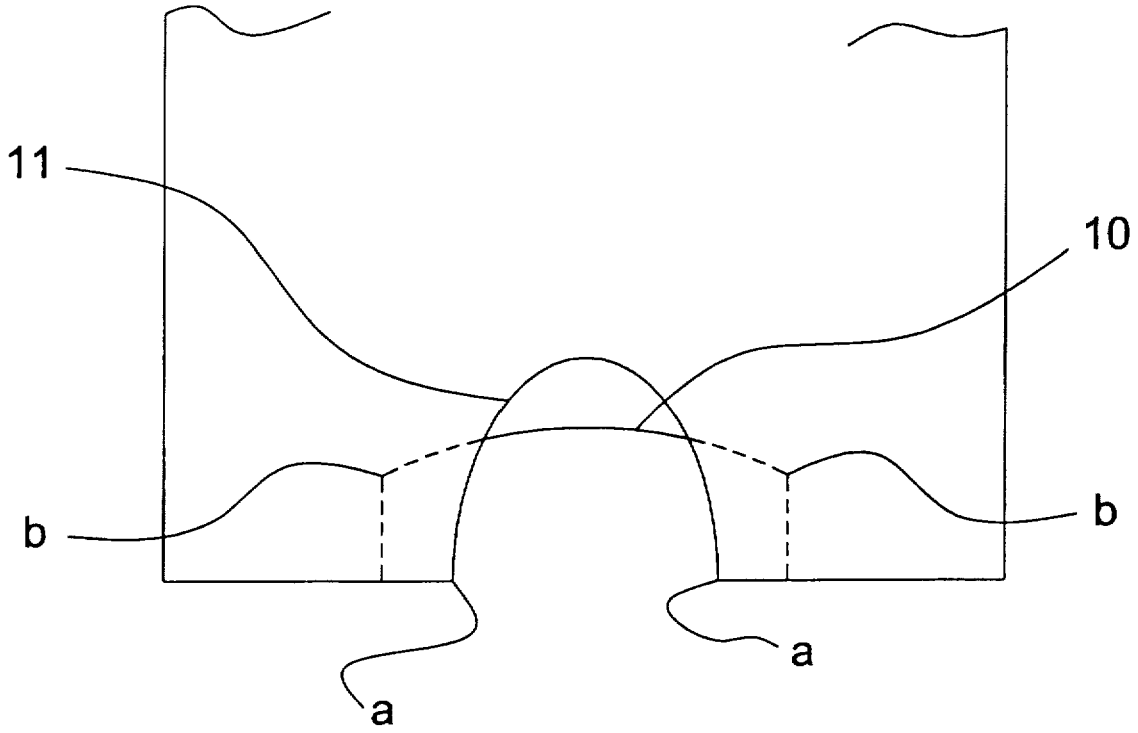
FIG. 13 is a view of the circular blade and the corner cutter blade in the embodiment of the invention wherein the corner cutter blade begins to cut the paper before the circular blade.

The movable blade unit 7 is composed of two blades, the circular blade 10 and the corner cutter blade 11. Both of the blades are located at the bottom of the movable blade unit 7 such that the width of the circular blade 10 (b—b in FIG. 13, P1—P1 in FIG. 2) is larger than the width of the corner cutter blade 11 (a—a in FIG. 13, P2—P2 in FIG. 2) and the apex of the curve of the circular blade 10 is lower than that of the corner cutter blade 11 (see drawing 13). According to this structure, at least during the cutting of the paper 1 along the line P1—P1 by the circular blade 10, the corner cutter blade 11 holds the paper 1 by cutting along the line P2—P2. In other words, the portion of the paper cut off by the circular blade 10 is tensioned between the circular blade 10 and the corner cutter blade 11. Therefore, even if the circular blade 10 becomes dull, the corner of the paper 1 may be prevented from being stuffed or bitten between the circular blade 10 and the stationary edge 9.

Since the configuration of the circular blade 10 and the corner cutter blade 11, which are provided on the bottom end of the movable blade unit 7, is made concave to the stationary edge 9 and the corner 102 can be cut lightly as if scissors were used, the corner cutter is handled easily as a business machine and the rounded corner 102 can be cut from both sides similarly. This secures the corner 105 as positioned without displacement to diminish the uneven alignment of the cut corners of multiple sheets.

Since on both sides of the circular blade 10 and the corner cutter blade 11, the support portions 12 are provided and the corner cutter blade 11 is attached to the circular blade 10, the positioning precision of the cut corner is increased and the uneven alignment of the cut corners is decreased. As the structure is simple, it becomes a cheap business machine. Also, as it is simple to insert the papers in the slit 6 and push down the holding portion 15, it is easy to operate as a business machine.

What is claimed is:

1. A corner cutter for cutting a corner of a sheet, comprising:

a stationary blade, said stationary blade being provided with a slit into which the corner of the sheet is to be inserted and a movable blade inserting hole which intersects perpendicularly to the slit;

a stationary edge within the stationary blade, the stationary edge being formed at an intersection between the slit and the movable blade inserting hole; and a movable blade unit slidably mounted within the movable blade inserting hole, the movable blade unit comprising a circular blade and a corner cutter blade, which are provided on a bottom end of the movable blade unit, wherein the circular blade cuts the sheet for a first duration and the corner cutter blade cuts the sheet for a second duration, the second duration being equal to the first duration, and the second duration begins no later than a start time of the first duration.

2. A corner cutter according to claim 1, further comprising guide portions adjacent the slit, the guide portions for guiding sides of the sheet which form the corner, wherein a radius of the circular blade is formed larger than a radius of a circle which is tangential to the guide portions.

3. A corner cutter according to claim 1, wherein the circular blade and the corner cutter blade provided on the bottom end of the movable blade unit, are concave with respect to the stationary edge.

4. A corner cutter according to claim 1, wherein the movable blade unit further comprises support portions, the support portions being adjacent the circular blade and the corner cutter blade.

5. A corner cutter for cutting a corner of a sheet, comprising:

a stationary blade, said stationary blade being provided with a slit into which the corner of the sheet is to be inserted and a movable blade inserting hole which intersects perpendicularly to the slit;

a stationary edge within the stationary blade, the stationary edge being formed at an intersection between the slit and the movable blade inserting hole; and a movable blade unit slidably mounted within the movable blade inserting hole, the movable blade unit comprising a circular blade and a comer cutter blade, which are provided on a bottom end of the movable blade unit, wherein the circular blade cuts the sheet for a first duration and the corner cutter blade cuts the sheet for a second duration, the second duration being longer than the first duration, and the second duration begins no later than a start time of the first duration.

6. A corner cutter according to claim 5, further comprising guide portions adjacent the slit, the guide portions for guiding sides of the sheet which form the corner, wherein a radius of the circular blade is formed larger than a radius of a circle which is tangential to the guide portions.

7. A corner cutter according to claim 5, wherein the circular blade and the corner cutter blade provided on the bottom end of the movable blade unit, are concave with respect to the stationary edge.

8. A corner cutter according to claim 5, wherein the movable blade unit further comprises support portions, the support portions being adjacent the circular blade and the corner cutter blade.

* * * * *